US009957712B1

(12) United States Patent
Smalley

(10) Patent No.: US 9,957,712 B1
(45) Date of Patent: May 1, 2018

(54) PURLIN, ROOFING SYSTEM, AND METHOD OF BUILDING A ROOFING SYSTEM

(75) Inventor: David Smalley, Marietta, GA (US)

(73) Assignee: Sustainable Solutions of North Georgia LLC, Talking Rock, GA (US)

( * ) Notice: Subject to any disclaimer, the term of this patent is extended or adjusted under 35 U.S.C. 154(b) by 990 days.

(21) Appl. No.: 13/596,506

(22) Filed: Aug. 28, 2012

Related U.S. Application Data

(60) Provisional application No. 61/529,986, filed on Sep. 1, 2011, provisional application No. 61/535,484, filed on Sep. 16, 2011.

(51) Int. Cl.
*E04B 5/40* (2006.01)
*E04B 5/10* (2006.01)

(52) U.S. Cl.
CPC ..... *E04B 5/10* (2013.01)

(58) Field of Classification Search
USPC ..... 52/220.2, 220.3, 335, 220.4, 643, 696, 52/690
See application file for complete search history.

(56) References Cited

U.S. PATENT DOCUMENTS

| | | | | |
|---|---|---|---|---|
| 2,720,290 | A * | 10/1955 | Henrickson | 52/506.06 |
| 3,812,636 | A * | 5/1974 | Albrecht et al. | 52/334 |
| 4,675,238 | A * | 6/1987 | Karoubas | 428/599 |
| 6,434,903 | B1 * | 8/2002 | Hertweck | 52/334 |
| 7,191,570 | B1 * | 3/2007 | Eaton | 52/506.09 |

OTHER PUBLICATIONS

JohnsonRollforming.com, Hat Channel, Dec. 28, 2010.*
W2 Formlok Metal Deck 9 (https://web.archive.org/web/20040516134354/http://dek-ing.com/dekfloor-w2formlok.html).*

* cited by examiner

*Primary Examiner* — Brian E Glessner
*Assistant Examiner* — Daniel J Kenny
(74) *Attorney, Agent, or Firm* — Hartman & Citrin LLC

(57) ABSTRACT

Concepts and technologies are disclosed herein for a purlin. The purlin can include a steel structure having a pair of outer flanges flaring away from a support surface for defining outer edges of the purlin. Connected to respective inner edges of the outer flanges along bent edges can be a pair of supports. The supports can be configured to engage a support surface and define a lower surface of the purlin. Connected to respective inner edges of the supports can be a pair of support webs that extend away from the support surface.

7 Claims, 6 Drawing Sheets

PURLIN, ROOFING SYSTEM, AND METHOD OF BUILDING A ROOFING SYSTEM

CROSS-REFERENCE TO RELATED APPLICATIONS

This patent application is related to and claims the benefit of U.S. Provisional Patent Application No. 61/529,986, filed on Sep. 1, 2011, entitled "Super Solar Purlin," and U.S. Provisional Patent Application No. 61/535,484, filed on Sep. 16, 2011, entitled "Super Solar Purlin," the entireties of which are hereby incorporated by reference in their entireties.

TECHNICAL FIELD

This disclosure relates to roofing system components and, more particularly, to a purlin design for use in building, modifying, and/or reinforcing roofing systems.

BACKGROUND

In many roofing systems, metal or wood trusses are used to support roof assemblies and/or to support the roofing systems. Trusses may include a variety of support members such as, for example, a top chord, web members, a bottom chord, and/or other members. Typically, the top chord is supported by a number of web members that extend from a bottom chord. A number of trusses may be placed on a building frame in a parallel spaced-apart arrangement. As such, the slope of the top chords can define the pitch of a roof. Additional support members, sometimes referred to as purlins, may be incorporated into roofing systems as well.

The purlins can be disposed at or on top of the top chords of the trusses top chords. The purlins can be arranged in a spaced-apart arrangement. The purlins also can be arranged in a direction perpendicular to the top chords. As such, the purlins can help support downward loads of roof assembly and/or can provide support for roofing system members between the trusses, if desired.

The use of purlins and/or trusses as discussed hereinabove can be particularly useful for supporting weight of roofing systems that incorporate heavy and/or dense members such as, for example, barrel roof tiles, stainless steel roofing systems, and/or other roofing systems. The purlins also can be used to help provide ventilation for a roofing system. More particularly, the purlins can be used to create a gap or air space between the trusses and roofing panels or other roofing structures. Providing gaps or air spaces such as those provided by purlins can help extend the life of roofing systems, can provide spaces to accommodate insulation, and/or can be beneficial for other reasons.

Purlins come in various shapes, dimensions, and/or can be formed from various materials. In particular, purlins may include dimensional lumber, formed sheet metal with right angle bends having one of several shapes. Purlins generally include a surface onto which roofing panels or other members can be mounted, and legs or webs that support the mounting surface. The legs or webs can be arranged perpendicular to the mounting surface and/or at an angle to provide structural support and/or to provide eased shipping, stacking, and/or other manufacturing processes. The purlins also can include mounting feet or webs with which the purlins are connected to the trusses or other roofing system members.

Such purlins may be used to meet certain determined roofing system performance requirements. For example, purlins can be designed and/or selected to provide vertical resistance to dead loads as required by various building codes and/or as specified by architectural, engineering, and/or other design specifications. The performance of the purlins and/or the entire roofing system can depend upon a variety of factors, including, but not limited to, the type, thickness, and spacing of the trusses and roof panels, as well as the type and placement of fasteners used to assemble the roofing system. Such performance is measured by a variety of organizations that test roof assemblies.

It is with respect to these and other considerations that the disclosure made herein is presented.

SUMMARY

Concepts and technologies are disclosed herein for an improved purlin design. According to some implementations, the purlin is a cold formed steel structure. In particular, the purlin can have a pair of outer flanges flaring away from a support surface, the outer flanges defining outer edges of the purlin. Connected to respective inner edges of the outer flanges along bent edges are a pair of feet, or supports. The feet, or supports, are configured to engage a support surface such as a truss or other surface and define the lower surface of the purlin.

Connected to respective inner edges of the feet, or supports, are a pair of support webs that extend upwards away from the support surface. The support webs provide rigidity for the purlin and create an air space between a support surface such as a truss or other surface, and a top portion of the purlin. The support webs can be connected to the feet, or supports, along respective bent edges as well. At the top of the purlin is an improved top portion that includes a substantially planar support surface for engaging a roof member such as a roofing panel or other structure. The top portion also has an indented trough section that reinforces the top portion and provides a raised flange for accommodating various structures. In some embodiments, the flanges and/or supports are configured to accommodate radiant heating tubes that are thereby placed in close proximity to the roofing panel and/or other structure supported by the purlin.

The purlin can be formed, forged, or otherwise obtained from light gauge steel or other suitable materials. Purlin collars and trusses according to various embodiments are also disclosed herein. In some embodiments disclosed herein, trusses, purlins, and/or purlin collars are formed from light gauge steel, while in other embodiments the trusses, purlins, and/or purlin collars are formed from composite materials with performance criteria that meet or exceed those of light gauge steel. Roof panels in accordance with the concepts and technologies disclosed herein can be formed from composite materials with performance criteria that meet or exceed those of APA approved structural panels.

In one embodiment the hat top and legs are approximately one and a half inches tall and have a top portion with a width of about two and three eighths inches. The trough section of the top portion can have a maximum depth of about one-quarter of an inch and a maximum width of about three eighths of an inch. In some embodiments, the trough is formed with an angle of about one hundred twenty degrees measured from a bottom surface of the top portion, extends downward about three eighths of an inch to achieve the maximum depth, and then returns to the top portion. In some embodiments, the radii of the trough section bends have an inner radius of about 0.0902 inches.

The support webs extend down from the top portion at an angle of about one hundred twenty degrees, measured from the lower surface of the top portion, and extend about one and three quarter inches down to the feet, or supports. Thus, the support webs can have an angle of about sixty degrees measured from a support surface such as a truss or other structure. The feet, or supports, can have a width of about seven eights of an inch. The outer flanges of the purlin can extend away from the feet, or supports, at an angle of about sixty degrees measured from the support surface (one hundred twenty degrees measured from the top of the feet, or supports, at a length of about one half of an inch. All bends of the purlins can, but do not necessarily, have a radius of about 0.0902 inches, and the material used to form the purlin has, in some embodiments, a thickness of about 0.0451 inches.

Various embodiments of the concepts and technologies disclosed herein also provide an arrangement of trusses, purlins, purlin collars, and roof panels wherein pin or nail fasteners can be installed with auto-nailers (also referred to herein as "automatic-nailers"), and which provides excellent wind-uplift performance. As used herein, a pin or nail is meant to include fasteners that can be driven or shot directly into the materials, such as with a hammer or nail gun, and need not be twisted as is typically required to insert screws. In one illustrative embodiment disclosed herein, heat treated ballistic point steel pins with a grip knurled shank are used. In one embodiment, automatic-nailers such as pneumatic nailers or nail guns with adjustable depth control are used to drive the steel pins.

According to various embodiments of the concepts and technologies disclosed herein, the purlins and/or roofing systems built using the disclosed purlins provide improved load bearing capabilities, relative to other roofing systems. Various embodiments of the concepts and technologies disclosed herein for trusses, purlins, and purlin collars also can provide excellent wind uplift performance. Embodiments of the concepts and technologies disclosed herein also can provide the ability to incorporate various green technologies such as solar energy solutions and/or other structures or devices into roofing systems. As such, embodiments of the concepts and technologies disclosed herein can be used to reduce the environmental impact of buildings or structures built that incorporate the various structures and/or systems disclosed herein.

Some embodiments of the concepts and technologies disclosed herein also provide an above the top chord roofing system which can incorporate one or more of the aforementioned purlins, purlin collars, nail or pin fasteners, and/or adhesives. In an illustrative embodiment, two or more trusses are spaced in a substantially parallel arrangement and two or more purlins are fastened to the truss top chords in a spaced apart arrangement using nail or pin fasteners. The purlins can be arranged such that the length of the purlins runs perpendicular to the length of the top chords of the trusses.

Purlin collars can be used to secure the purlins to the trusses with or without adhesives and/or mechanical fasteners such as nail or pin fasteners. Roofing panels can be positioned and fastened to the purlins using any desired fastener patterns. The present disclosure further provides a faster and safer method of installing a roof system.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DESCRIPTION

Figure 1:
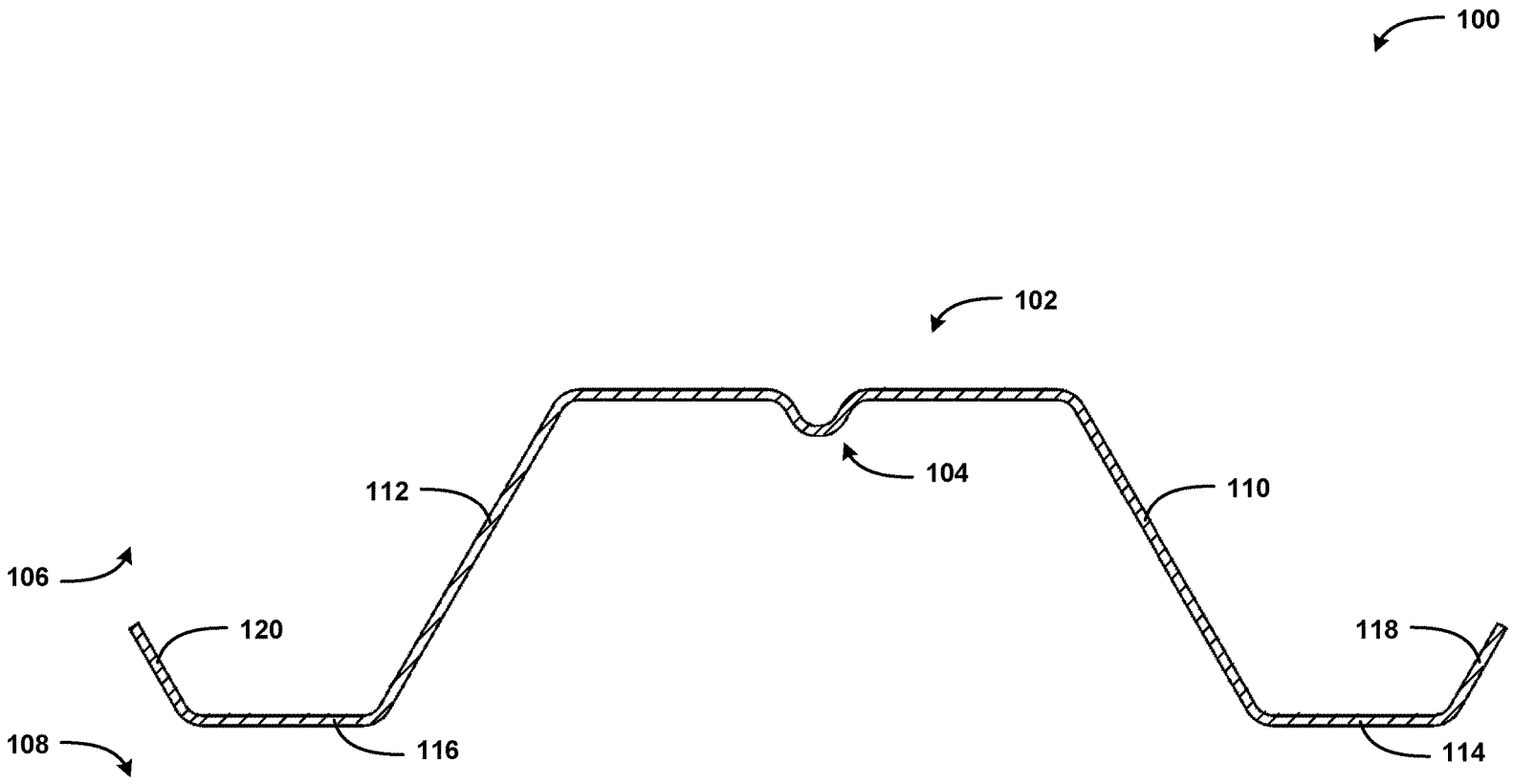
FIG. 1 is a cross-section view of a purlin, according to one illustrative embodiment.

The following detailed description is directed to purlins. According to some implementations, the purlins are cold formed steel structures having a pair of outer flanges flaring away from a support surface, the outer flanges defining outer edges of the purlin. Connected to respective inner edges of the outer flanges along bent edges is a pair of supports. The supports are configured to engage a support surface such as a truss or other surface and define the lower surface of the purlin.

Connected to respective inner edges of the supports is a pair of support webs that extend away from the support surface. The support webs provide rigidity for the purlin and extend to engage a top portion of the purlin. The top of the purlin includes a substantially planar support surface and an indented trough section that reinforces the top portion and provides a raised flange for accommodating various structures. In some embodiments, the supports and/or flanges are configured to accommodate radiant heating tubes that are thereby placed in close proximity to the roofing panel and/or other structure supported by the purlin.

In the following detailed description, references are made to the accompanying drawings that form a part hereof, and in which are shown by way of illustration specific embodiments or examples. It must be understood that the disclosed embodiments are merely exemplary of the concepts and technologies disclosed herein. The concepts and technologies disclosed herein may be embodied in various and alternative forms, and/or in various combinations of the embodiments disclosed herein.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a purlin roofing system will be presented.

Figure 2:
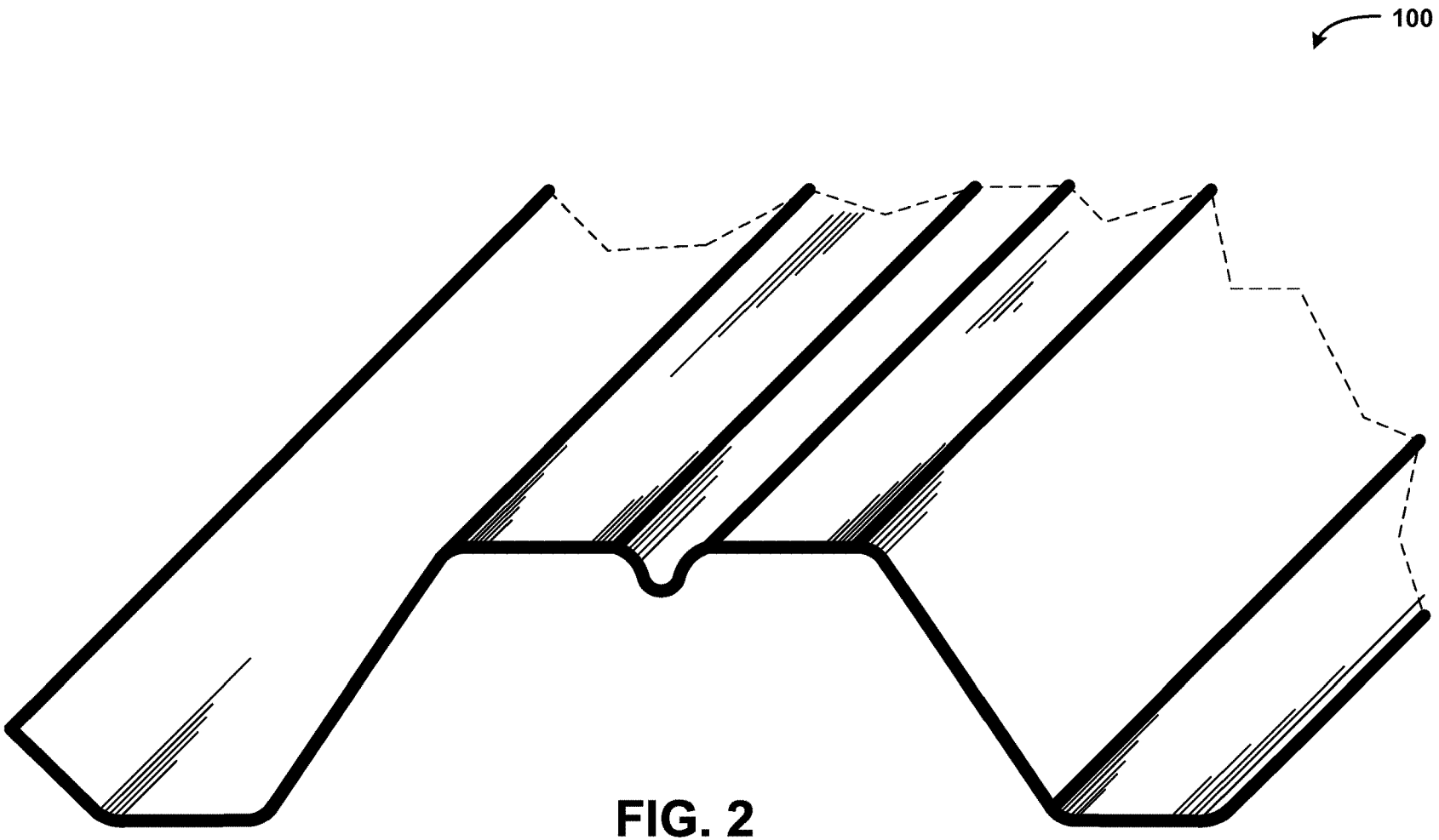
FIG. 2 is a perspective view of the purlin illustrated in FIG. 1.

Referring to the drawings, wherein like elements are designated by like numbers throughout, FIGS. 1 and 2 illustrate a purlin 100 according to an exemplary illustrative embodiment. The purlin 100 may also be referred to herein as a modified hat cross section. In particular, the purlin 100 has a generally horizontal top region 102. The top region 102 has a trough section 104 that extends away from a top of the purlin ("top"), indicated generally at 106, and towards a bottom of the purlin, indicated generally at 108. The trough section 104 can provide a recess in the top region 102. In some embodiments, the trough section 104 can be, but is not necessarily, used to house or provide a region into which structures, devices, or elements can be placed or located.

The top region 102 can be supported by two support webs 110, 112. The support webs 110, 112 can extend up toward the top region 102 from the bottom 108 of the purlin 100. In some embodiments, the purlin 100 also includes two feet, or supports ("supports") 114, 116. The supports 114, 116 can engage a support surface such as a truss or other roofing system component to support the purlin 100, to transfer loads from the top portion to the support surface, to attach the purlin 100 to the support surface, and to provide support and/or rigidity for the purlin 100.

According to various embodiments, the purlin 100 also includes two flanges 118, 120 that extend away from the support surface and the supports 114, 116. The flanges 118, 120 can provide support and rigidity to the purlin 100. The flanges 118, 120 also can be used to ensure that the supports 114, 116 engage the support surface.

In the illustrated exemplary embodiment, the purlin 100 is made of cold formed steel with a G60 galvanized surface and bent formed through bends into a desired cross section. A width of the top region 102 can have sufficient surface area for securing roofing panels, such as plywood or OSB structural panels, to the purlin 100. In the exemplary embodiment, the width of the top region 102 is sufficient to accommodate two rows of nail fasteners, one row for each panel edge.

The length of the purlin 100 (not fully illustrated in the FIGURES) can be any dimension. The length of the purlin 100 can be based upon an intended use. In one embodiment, the length of the purlin 100 is about sixteen feet and six inches. It should be understood that this embodiment is illustrative, and should not be construed as being limiting in any way.

In some embodiments, the purlin 100 are fastened to trusses that are arranged about forty-eight inches apart, on center. As is known, a forty-eight inch space between trusses is larger than typically is safe or reasonable in roofing systems. The ability to space the trusses apart can result, at least in part, from the rigidity of the purlin 100. As is known, the ability to reduce the number of trusses used in a roofing system can allow reduction in a weight of a roofing system, reduction of materials needed to build the roofing system, a reduction in transportation, manufacturing, and warehousing requirements.

As such, some embodiments of the concepts and technologies disclosed herein can be used to realize a reduction in overall construction costs associated with constructing a roofing system. Similarly, some embodiments of the concepts and technologies disclosed herein can be used to realize a reduction in the environmental impact associated with constructing a roofing system. Finally, some embodiments of the concepts and technologies disclosed herein can be used to realize a reduction in the weight of roofing systems built according to the concepts and technologies disclosed herein, while providing enhanced strength and rigidity, relative to other roofing systems.

A height of the purlin 100 can correspond to a dimension of the purlin 100 measured from the bottom of the supports 114, 116 to the top of the top region 102, or vice versa. The height of the purlin 100 can be determined by the intended use of the purlin 100, if desired. In some embodiments, the height of the purlin 100 is determined based, at least partially, upon a depth necessary to install rigid or batt insulation between the top chord of the truss or other support structure and a roof panel or other structure attached to the purlin 100. Similarly, if a moisture, noise, vapor, or other barrier is placed between the top chord and the purlin 100, for example a plastic vapor barrier, the height of the purlin 100 can determine the amount of ventilation available under various conditions.

The purlin 100 can be attached to a truss or other support structure. In some embodiments, the purlin 100 is attached to a top chord of the trusses using fasteners that are inserted into and through the supports 114, 116. In some embodiments, additional or alternative fasteners are used to attach the purlin 100 to a support surface. For example, in some embodiments an adhesive or other chemical fastener can be used instead of, or in conjunction with, nails, screws, pins, or other mechanical fasteners. It should be understood that these embodiments are illustrative, and should not be construed as being limiting in any way.

In some embodiments, the use of the purlin 100 can provide exceptional uplift and load bearing capabilities. In particular, some embodiments of the purlin 100 are formed from inexpensive light gauge steel, but still can effectively meet or exceed wind uplift requirements and/or load bearing requirements or specifications. However, characteristics and dimensions of the purlin 100, including material, gauge, and finish can vary depending upon the particular application without departing from the scope of the claims. For example, in other embodiments the trusses, purlins, and purlin collars can include composite materials with performance criteria that meet or exceed those of light gauge steel, and the roof panels can include composite materials with performance criteria that meet or exceed those of American Plywood Association (APA) approved structural panels.

Figure 3:
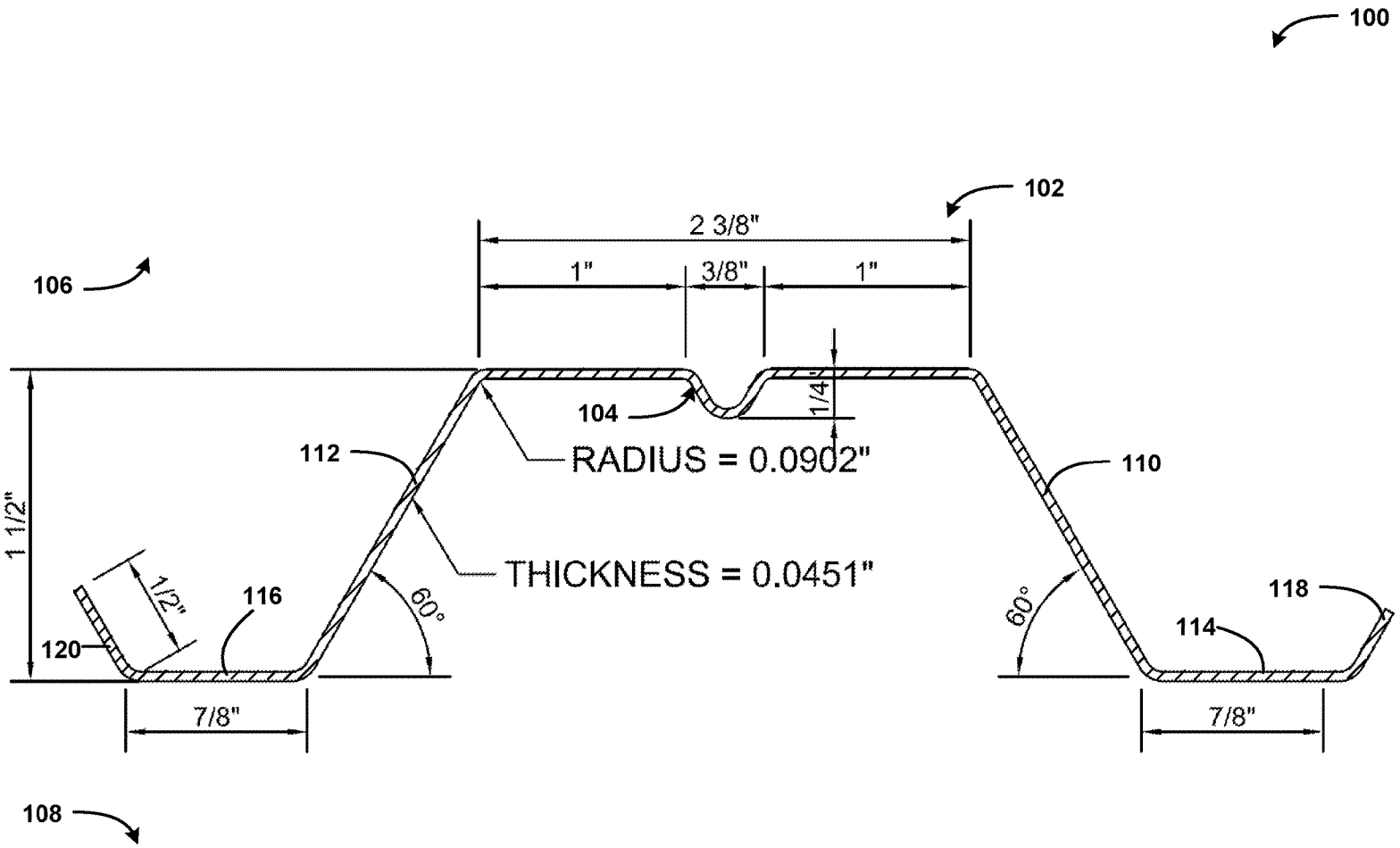
FIG. 3 is a cross section view of a purlin, according to another illustrative embodiment.

Turning now to FIG. 3, a purlin 100 according to one embodiment is shown in detail. The purlin 100 can be, but is not necessarily, identical to the purlin 100 shown in FIG. 1. As such, the dimensions shown in FIG. 3 are illustrative of only one embodiment of the purlin 100 disclosed herein and therefore should not be construed as being limiting in any way.

In the illustrated embodiment shown in FIG. 3, the top region 102 of the purlin 100 can have a width of about two and three eighths inches. The total height of the purlin 100 from the bottom of the supports 114, 116 to the top of the top region 102 can be approximately one and a half inches. The trough section 104 of the purlin 100 can have a depth of about one-quarter of an inch measured from the maximum depth to the top of the top region 102. The trough section 104 also can have a maximum width of about three eighths of an inch.

In some embodiments, the trough section 104 is formed as having an angle of about one hundred twenty degrees measured from a bottom surface of the top region 102 to the closest, or facing, surface of the trough section 104. The trough section 104 also can extend downward, i.e., away from the top region 102, about three eighths of an inch to achieve a maximum depth. In some embodiments, the bends of the trough section 104, as well as other bends of the solar purlin 100, have an inner radius of about 0.0902 inches. It should be understood that these embodiments are illustrative, and should not be construed as being limiting in any way.

The support webs 110, 112 of the solar purlin 100 can extend downward, i.e., away from the top region 102 and toward the supports 114, 116. In some embodiments, the support webs 110, 112 extend at an angle of about one hundred twenty degrees, measured from the lower surface of the top region 102 to a nearest or facing surface of the support webs 110, 112. The support webs 110, 112 can extend about one and three quarter inches in length, though this dimension is not labeled in FIG. 3 as it can be easily determined by the other provided dimensions.

The support webs 110, 112 can extend down to the supports 114, 116 at an angle of about sixty degrees measured from a support surface, such as a truss or other structure, up to the support webs 110, 112, as shown in FIG. 3. The supports 114, 116 can have a width of about seven eights of an inch. The outer flanges 118, 120 can be connected to an edge of the supports 114, 116 and can extend away from supports 114, 116 at an angle of about sixty degrees measured from the support surface (one hundred twenty degrees measured from the top of the supports 114, 116). The flanges 118, 120 can have a length of about one half of an inch.

According to one embodiment of the concepts and technologies disclosed herein, some, none, or all bends of the purlin 100 can, but do not necessarily, have a radius of about 0.0902 inches, as shown in FIG. 3. The material used to form the purlin 100 has, in some embodiments, a thickness of about 0.0451 inches. It should be understood that these embodiments are illustrative, and should not be construed as being limiting in any way.

The purlin 100, can be fastened to a metal truss top chord (not shown) with pneumatically applied nails or pins. In some embodiments, the truss top chord and the purlin 100, are made from light gauge steel, providing a metal to metal connection. In other embodiments a vapor barrier or other building material that does not reduce the uplift strength of the fasteners in the metal to metal connection can be placed between the top chord and the purlin 100. The nails or other fasteners used to fasten the purlin 100 to the trusses or other support structure can be heat treated ballistic point steel pins having a head. In some embodiments, the head of the steel pins have a diameter of about one quarter inch and a shank having a length of about three quarters of an inch and having a diameter of about one tenth of an inch. One example of such fasteners is sold under the name GRIPSHANK. It should be understood that this embodiment is illustrative, and should not be construed as being limiting in any way.

An auto-nailer such as a pneumatic nailer with adjustable depth control and auto-centering can be used to drive the pins to a desired depth. In some embodiments, the use of the nails can help reduce installation time. Use of the pneumatic nailer also can help reduce worker fatigue and can eliminate the cost of broken drill bits while providing a roof with excellent wind-uplift performance. It is believed that the ballistic-shaped point uniformly pierces the steel such that the displaced steel rebounds around the pin to create a strong compressive force on the knurled pin shank to help prevent withdrawal of the pin. Of course other sized nail or pin fasteners can be used, depending upon the particular materials being fastened and the design criteria, without departing from the scope of the claims.

In some embodiments, one or more pins or other fasteners are included near the location at which each support 114, 116 of the purlin 100 rests atop each truss top chord or other support structure, to secure the purlin 100 to the support surface. The illustrated supports 114, 116 provide surface area to accommodate the fastening of a nail, pin, or other fastener for fastening the purlin 100 to the top chord of the trusses or other support surface. In some embodiments, the width of the supports 114, 116 is increased beyond the illustrated configuration such that the supports 114, 116 can accommodate multiple pins, nails, or other fasteners.

In some embodiments, including multiple fasteners in the supports 114, 116 can help increase the uplift strength of the purlin 100 and/or increase the load bearing capabilities of the purlin 100 relative to embodiments incorporating only one fastener through the supports 114, 116. Furthermore, in some embodiments, some of the purlin 100 used in a roofing system are not connected with fasteners to a truss or other support surface. Thus, for example, one or more purlin 100 of a roofing system can be configured to slip along the truss or other support surface. Some such embodiments allow for expansion and contraction of the roofing system and can be provided at selected fastener locations.

In some embodiments, a purlin collar can be secured over the purlin 100. It should be understood that a purlin collar can provide a reinforced connection between a purlin 100 and a truss or other support surface. Specifically, the use of a purlin collar in a roofing system can increase the wind uplift resistance performance of the roofing system. The cross section of the purlin collar can be such that the purlin collar passes over the top region 102 of the purlin 100, and down at an angle such that the purlin collar passes over the outside edges of the flanges 118, 120 before intersecting a support surface such as a truss. The profile of the purlin collar can be modified for various purposes, and therefore the above-described embodiment is illustrative and should not be construed as being limiting in any way.

In some embodiments, the purlin collar is made of 18 gauge cold formed steel with a G60 galvanized surface and bent formed through any number of bends into a desired cross section. In various embodiments, the dimensions of the purlin collar can be slightly greater than the dimensions of the purlin 100 since the purlin collar can be dimensioned/configured to be placed over the purlin 100. Furthermore, the dimensions of the purlin collar can be selected such that, as the purlin collar is placed over the purlin 100, the inside surface of a top region of the purlin collar contacts an outside surface of the top region 102 and/or a portion or portions of the support webs 110, 112 the supports 114, 116 and/or the flanges 118, 120. It should be understood that these embodiments are illustrative, and should not be construed as being limiting in any way.

The purlin collar can be secured to a truss top chord or other support surface to strengthen the connection between the truss top chord or other support surface and the purlin 100. Furthermore, the purlin collar can be connected to the purlin 100 to further strengthen the roofing system. For example, an adhesive can provide a securing connection between the top region 102 of the purlin 100 and a top region of the purlin collar. Further, an adhesive can provide an additional securing connection for supports of the purlin collar, which can be secured with the adhesive to the truss top chord or other support surface. As used herein, the term adhesive is broadly defined and includes acrylic adhesives, epoxies, or structural acrylic adhesives, other suitable adhesives, and combinations and/or equivalents thereof. In some embodiments, an acrylic adhesive used in roofing systems built in accordance with the concepts and technologies disclosed herein include, but are not limited to, a member of the LOCTITE family of adhesive products such as the H8600 product. It should be understood that this embodiment is illustrative, and should not be construed as being limiting in any way. The purlin collar also can be secured to the truss top chord or other support surface with pins, nails, or other fasteners inserted through the supports thereof, as described above with respect to the fastening of the purlin 100 to the truss top chord or other support surface.

Roof decking panels can be fastened to the purlin 100 and/or the purlin collar. In some embodiments, three-quarter-inch thick plywood panels or other thicknesses can be attached to the top region 102 by one or more pins, nails, or other fastening mechanisms. The width of the illustrated top region 102 can allow for the spaced-connection of the roof panels, in some embodiments. Other widths of the top region 102 is possible and can be selected based upon design criteria and/or other considerations.

The pins, nails, or other fastening mechanisms used to secure the roofing panels to the purlin 100 and/or the purlin collars, can be similar to the pins, nails, or other fastening mechanisms used to secure the supports 114, 116 of the purlin 100 to the support surface. In some embodiments, however, the pins, nails, or other fastening mechanisms used to secure the roofing panels can have a longer shank than the pins, nails, or other fastening mechanisms used in the supports 114, 116. In some embodiments, the pins, nails, or other fastening mechanisms used to secure the roofing panels are heat treated ballistic point steel pins having a length of one and three eighths inches, a one quarter inch head, and a one tenth of an inch shank diameter with a grip knurl. One such type of pin is sold under the name GRIP-SHANK. It should be understood that this embodiment is illustrative, and should not be construed as being limiting in any way.

By way of example and not limitation, the illustrated top region 102 has a two and three eighths of an inch width. This width can allow a nail pattern of one tenth of an inch diameter nails located six inches apart, on-center, and about three eighths of an inch from the beginning of the sloping downward support webs 110, 112. Other nails and nail patterns can be selected according to other design criteria.

Figure 4:
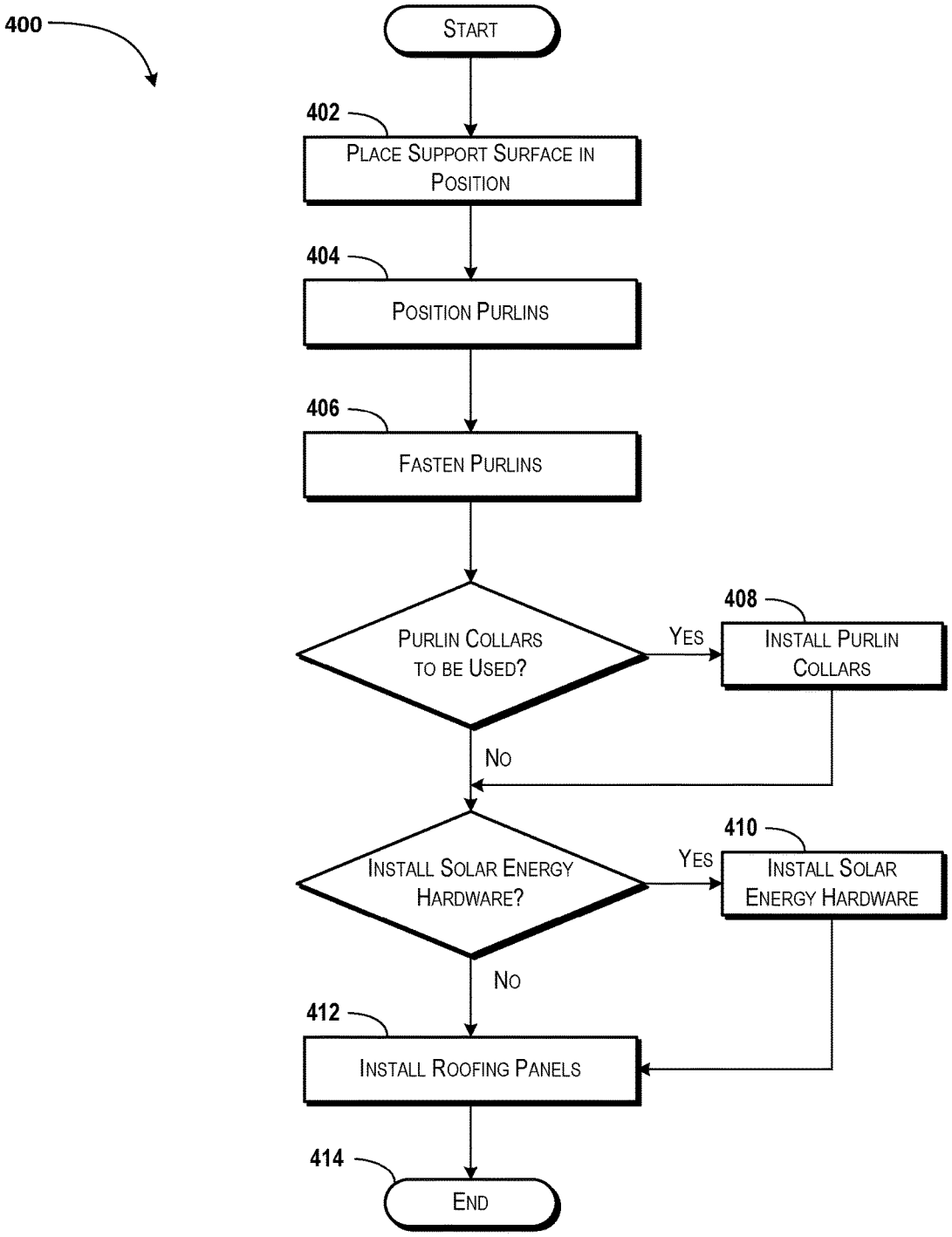
FIG. 4 is a block diagram schematically illustrating a method for building a roofing system that includes purlins, according to an illustrative embodiment.

Turning now to FIG. 4, aspects of a method 400 for building a roofing system incorporating purlin 100 will be described in detail. It should be understood that the operations of the method 400 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims. It also should be understood that the illustrated method 400 can be ended at any time and need not be performed in its entirety.

The method 400 for building a roofing assembly incorporating purlin 100 begins at operation 402, wherein a support surface for the purlin 100 is placed in position. In some embodiments, the support surface includes a truss. A truss can be supported by a truss bearing member and can include a top chord, a bottom chord, and one or more webs supporting the top chord at a desired slope.

Because the shapes and configurations of trusses can be varied based upon any number of design, aesthetic, architectural, legal, and/or other considerations, and because truss design is generally well known, specific truss shapes are not described in additional detail herein. Rather, the top chord, a standard feature of a truss, is discussed as the top chord is, in many embodiments, the interfacing surface at which the truss and the purlin 100 contact one another. The trusses can be made of light-gauge metal such as steel and can have a truss heel. In some embodiments, the truss heel measures at least three and thirteen sixteenths inches. The trusses can be arranged forty eight inches apart, on-center. It should be understood that these embodiments are illustrative, and should not be construed as being limiting in any way.

From operation 402, the method 400 proceeds to operation 404, wherein the purlin 100, are placed in contact with the trusses. In some embodiments, a starter-terminator purlin is also attached to the truss heels and/or truss top chords to provide a soffit-fascia surface, as is described in other co-pending applications filed by the Applicant. It can be appreciated that one or more surfaces of the starter-terminators described in these other applications can be modified to have a flange and/or support similar to the flanges 118, 120 and/or supports 114, 116 of the purlin 100.

In one embodiment, wherein the trusses are arranged forty eight inches apart, on-center, purlin 100 and/or starter-terminators having lengths of sixteen feet and six inches can be used to traverse four bays defined by the spaced apart trusses. As such, some embodiments of the roofing system described herein allow for about three inches of the integrated starter-terminators and/or purlin 100 to extend beyond the top chord of the trusses. Sleeves (not shown) can be attached to integrated starter-terminators so that one or more adjacent integrated starter-terminators can be end butt-connected and sealed with a caulk bead or other sealant. Alternatively, the starter-terminators can be overlapped.

From operation 404, the method 400 proceeds to operation 406, wherein the purlin 100 are fastened or attached to the truss top chords. In some embodiments, the purlin 100 are fastened to the trusses in a parallel spaced apart configuration. As explained above, the purlin 100 can be secured with adhesives, pins, nails, other chemical and/or mechanical fasteners, and the like. In some embodiments, the purlin 100 are welded to the trusses.

In one embodiment, wherein the trusses are arranged four feet apart, on-center, the purlin 100 can be arranged twenty four inches apart, on center. The purlin 100 can be arranged such that lengths of the purlin 100 are arranged in a direction substantially perpendicular to a direction of a length of the top chords. Because the arrangement of trusses and purlins are generally known in the constructions industry, this arrangement is not further described herein. As discussed above, the pins, nails, or other mechanical fasteners can be inserted into the purlin 100 using an auto-nailer to fasten the purlin 100 to the top chords through the supports 114, 116. It should be understood that these embodiments are illustrative, and should not be construed as being limiting in any way.

Figure 5:
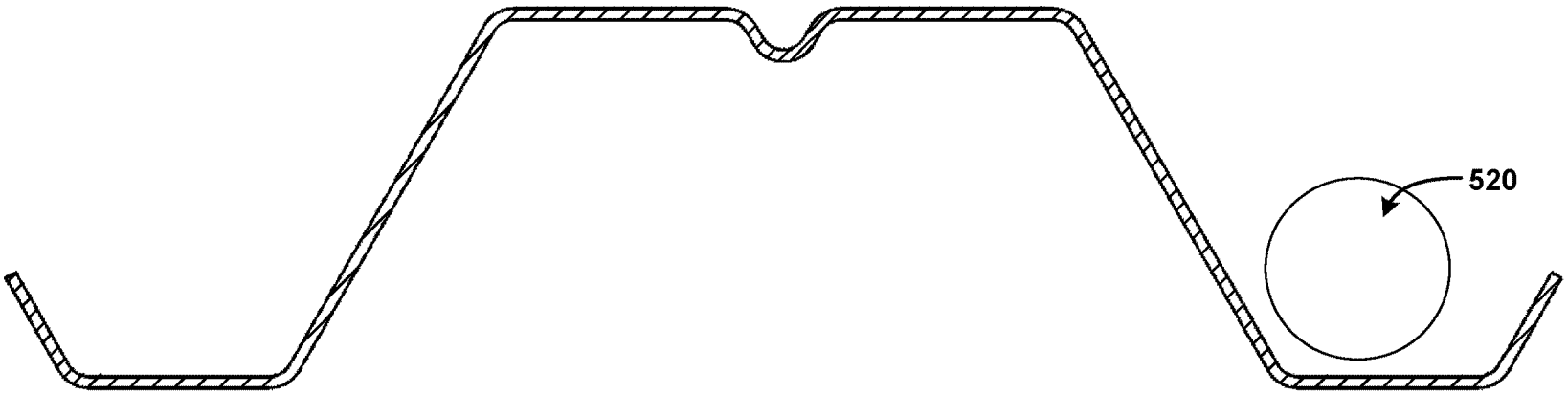
FIG. 5 is a cross section view of an illustrative implementation of a purlin, according to an illustrative embodiment.

From operation 406, the method 400 can proceeds to operation 408, wherein purlin collars can be attached to the purlin 100, if used in the roofing system. From operation 408, the method 400 can proceeds to operation 410, wherein solar energy hardware can be installed in the roofing system, if used. In some embodiments, the solar energy hardware is installed at a location proximate to the supports 114, 116 and/or the flanges 118, 120 of the purlin 100, though this is not necessarily the case. In one contemplated implementation, thermal tubes 502 are carried in the space formed between the supports 114, 116 and the flanges 118, 120. An example of such an implementation is illustrated in FIG. 5. The thermal tubes 502 can be collected from solar film, solar arrays, or other solar energy hardware and/or can be routed along the slope of the trusses or other support surface in a cavity or other opening in the truss, if desired.

Figure 6:
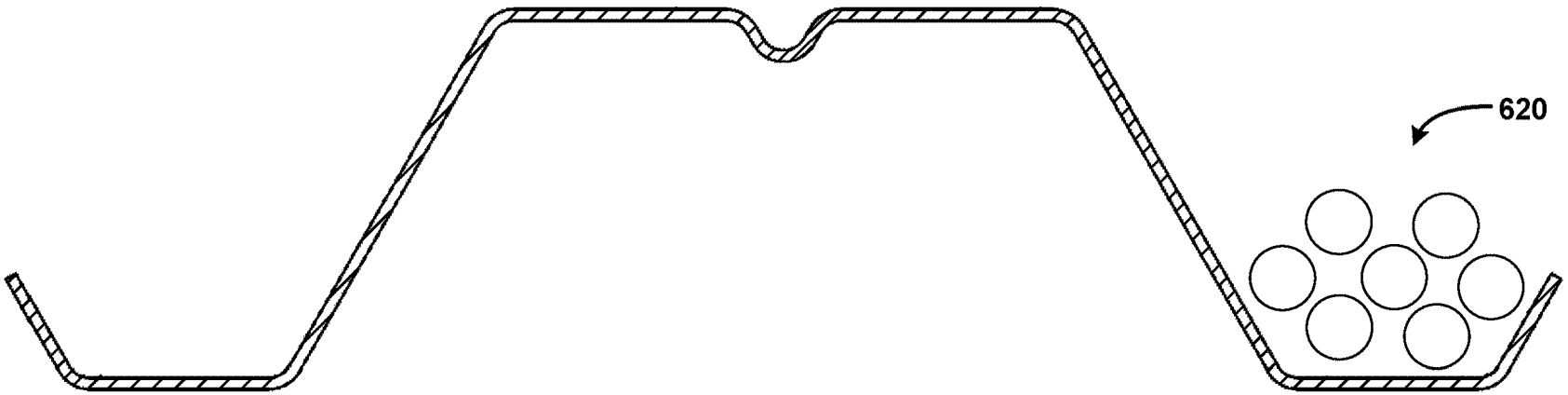
FIG. 6 is a cross section view of an illustrative implementation of a purlin, according to another illustrative embodiment.

Additionally, or alternatively, the space formed between the supports 114, 116 and/or the flanges 118, 120 can carry daisy chain wiring 602 associated with the solar energy hardware, if desired. An example of such an implementation is illustrated in FIG. 6. The wiring 602 and/or thermal tubes 502 can be collected at the peak of the trusses or other support surface, if desired, for connections to electrical apparatus. It should be understood that these embodiments are illustrative, and should not be construed as being limiting in any way. From operation 410, and/or from operation 406 if purlin collars and/or solar energy hardware are not used in the roofing system, and/or from operation 408 if solar energy hardware is not included in the roofing system, the method 400 proceeds to operation 412. At operation 412, roofing panels can be fastened to the top region 102 of the purlin 100 and/or integrated starter-terminators, if included. The pin fasteners, as discussed above, can be inserted using an auto-nailer. In one embodiment in which the purlin 100 are arranged twenty four inches apart, on-center, four feet wide by eight feet long, by three quarters of an inch thick plywood panels can be used.

The roof panels can be spaced and placed atop the purlin 100. In one embodiment, there is sufficient edge distance within the top region 102 of the purlin 100 from the centerline to the fastener so that nails can be shot down on two or more roof panels that meet at the top region 102 of the purlin 100. As such, suitable bearing surface for the roof panels can be provided by the purlin 100 while maintaining the integrity of the roof panels. Roof panel materials other than structural plywood or OSB panels can be used, though use of other roof panel materials may require different purlin 100 top region 102 dimensions. A six inch apart, on-center nail pattern can be used for a hundred twenty mile per hour or more wind-resistant roofing system, in some embodiments. From operation 412, the method 400 proceeds to operation 414, whereat the method 400 ends.

Various embodiments of the purlin 100 have been described herein. In some embodiments, the material used to form the purlin 100 is A653 stainless steel grade 50/1 having a modulus of elasticity of about 29,500 ksi, a yield strength of about 50 ksi, and a tensile strength of about 65 ksi. In some embodiments, the material used to form the purlin 100 is 18 gauge, i.e., about 0.0451 inches thick. It should be understood that these embodiments are illustrative, and should not be construed as being limiting in any way.

One embodiment of the purlin 100 shown in FIG. 3 has a flat width of about 8.3663 inches and a weight of about 1.28 pounds/foot. In some embodiments, the purlin 100 has an area of about 0.377 square inches. In some embodiments, the purlin 100 has a gross moment of inertia $I_x$ of about 0.1323 $in^4$. In some embodiments, the purlin 100 has a positive effective $I_x$ and negative effective $I_x$ that are substantially equivalent to one another, and measure about 0.1323 $in^4$. In some embodiments, the positive and negative allowable bending strengths of the purlin 100 are substantially equivalent and measure about 5.269 kip/inch. In some embodiments, the allowable shear strength of the purlin 100 is about 2.34 kip. It should be understood that these embodiments are illustrative, and should not be construed as being limiting in any way.

One embodiment of the purlin 100 having a width of about 8.3663 inches, an area of about 0.377 square inches, a weight of about 1.28 pounds/foot, a gross moment of inertia $I_x$ of about 0.1323 $in^4$ and substantially equivalent positive effective $I_x$ and negative effective $I_x$, an allowable bending strength of about 5.269 kip/inch, and an allowable shear strength of about 2.34 kip has been compared to a traditional top-hat purlin having a flat width of about 7.3829 inches, an area of about 0.332 square inches, a weight of about 1.13 pounds/foot, a gross moment of inertia $I_x$ of about 0.1214 $in^4$, a positive effective $I_x$ of about 0.1101 $in^4$, a negative effective $I_x$ of about 0.1073 $in^4$, a positive allowable bending strength of about 4.335 kip/inch, a negative allowable bending strength of about 3.713 kip/inch, and an allowable shear strength of about 2.26 kip. The results of this comparison revealed that relative to the traditional top-hat purlin, the purlin 100 provides about forty-two percent (42%) increase in strength over the top-hat purlin while only consuming about thirteen percent (13%) more steel than the top-hat purlin. It should be understood that this embodiment is illustrative, and should not be construed as being limiting in any way.

Based on the foregoing, it should be appreciated that a purlin has been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A roofing system purlin comprising:

a substantially planar top region having a first edge, a second edge, a bottom surface, and a top surface, wherein the top surface supports a roof panel of the roofing system, and wherein the top region further comprises a trough section comprising a curved surface that begins at the top surface, extends away from the top surface, and returns to the top surface along a radius about a center of the top region;

a first support web extending away from the top surface and away from the center of the top region, the first support web being joined to the first edge of the top region and ending at a first support, wherein an outside surface of the first support web is arranged at an angle of about sixty degrees relative to the top surface, and wherein an inside surface of the first support web is arranged at an angle of about one hundred twenty degrees relative to the bottom surface;

a second support web extending away from the top surface and away from the center of the top region, the second support web being joined to the second edge of the top region and ending at a second support, wherein an outside surface of the second support web is arranged at an angle of about sixty degrees relative to the top surface, and wherein an inside surface of the second support web is arranged at an angle of about one hundred twenty degrees relative to the bottom surface;

a first outer flange joined to the first support, the first outer flange extending away from the center of the top region and extending toward the top surface of the top region, the first outer flange extending away from the first support at an angle of about one hundred twenty degrees relative to the first support; and a second outer flange joined to the second support, the second outer flange extending away from the center of the top region and extending toward the top surface of the top region.

2. The purlin of claim 1, wherein the radius comprises about nine hundredths of an inch.

3. The purlin of claim 2, wherein the trough section has a depth of about one quarter of an inch, measured from a bottom surface of the trough section to the top surface of the top region.

4. The purlin of claim 3, wherein the purlin is formed from steel.

5. The purlin of claim 1, wherein the support webs, the supports, and the outer flanges cooperate to form a solar energy hardware region into which solar energy hardware is located.

6. The purlin of claim 1, wherein the second outer flange extends away from the second support at an angle of about one hundred twenty degrees relative to the second support.

7. The purlin of claim 6, wherein an angle of about sixty degrees is formed between each of the outer flanges and a surface that contacts the supports.

* * * * *